US006086070A

United States Patent [19]

Tremoulet, Jr. et al.

[11] Patent Number: 6,086,070

[45] Date of Patent: Jul. 11, 2000

[54] HIGH PRESSURE FLUID SEAL ASSEMBLY

[75] Inventors: Olivier L. Tremoulet, Jr., Edmonds; Chidambaram Raghavan, Kent, both of Wash.

[73] Assignee: Flow International Corporation, Kent, Wash.

[21] Appl. No.: 08/932,690

[22] Filed: Sep. 18, 1997

[51] Int. Cl.[7] ..... F16J 15/16

[52] U.S. Cl. ..... 277/586

[58] Field of Search ..... 277/586, 500; 29/83

[56] References Cited

U.S. PATENT DOCUMENTS

| | | | |
|---|---|---|---|
| 1,443,675 | 1/1923 | Bowler . | |
| 2,059,759 | 11/1936 | Stearns . | |
| 2,429,578 | 10/1947 | Gleasman . | |
| 3,550,617 | 12/1970 | Johnson . | |
| 3,776,558 | 12/1973 | Mauer et al. . | |
| 4,101,099 | 7/1978 | Hickle . | |
| 4,103,849 | 8/1978 | Holt et al. . | |
| 4,350,179 | 9/1982 | Bunn et al. . | |
| 4,448,574 | 5/1984 | Shimizu . | |
| 4,620,562 | 11/1986 | Pacht . | |
| 4,637,419 | 1/1987 | Hughes . | |
| 5,050,895 | 9/1991 | Hashish et al. | 277/584 |
| 5,127,807 | 7/1992 | Eslinger . | |
| 5,493,954 | 2/1996 | Kostohris et al. . | |
| 5,564,469 | 10/1996 | Tremoulet, Jr. et al. . | |
| 5,692,851 | 12/1997 | Pace . | |
| 5,787,793 | 8/1998 | Niwa et al. . | |

FOREIGN PATENT DOCUMENTS

| | | |
|---|---|---|
| 0 391 488 A2 | 10/1990 | European Pat. Off. . |
| 0 870 956 A1 | 8/1997 | European Pat. Off. . |
| 0 870 956 A1 | 10/1998 | European Pat. Off. . |
| 2 342 412 | 9/1977 | France . |
| 35 34149 | 1/1987 | Germany . |
| 1 407 874 | 10/1975 | United Kingdom . |
| 2216942 | 10/1989 | United Kingdom . |

*Primary Examiner*—Anthony Knight
*Assistant Examiner*—Karlena D. Schwing
*Attorney, Agent, or Firm*—Seed IP Law Group

[57] ABSTRACT

A high pressure fluid seal assembly is shown and described. The seal assembly includes a seal carrier having a bore through which a reciprocating pump plunger may pass, the seal carrier having a first annular groove concentric with the bore, and carrying an annular seal. The seal carrier further includes an integral annular guidance bearing positioned in a second annular groove of the seal carrier, the second annular groove and guidance bearing contained therein being axially spaced from the first annular groove and seal contained therein. An inner diameter of the guidance bearing is smaller than an inner diameter of the seal carrier in a region between the seal and the guidance bearing. The seal is therefore supported directly by the seal carrier, although the seal carrier is spaced from the reciprocating plunger by the guidance bearing. Frictional heating in the region of the seal is therefore reduced, thereby increasing the life of the seal. Materials for the plunger, seal and guidance bearing are selected to minimize friction between the plunger and seal and between the plunger and guidance bearing. Furthermore, the seal assembly is manufactured by pressing the guidance bearing into the seal carrier, and then machining the bore in the guidance bearing and in the seal carrier in the same setup, thereby improving the alignment of the elements and simplifying manufacturing.

10 Claims, 2 Drawing Sheets

HIGH PRESSURE FLUID SEAL ASSEMBLY

TECHNICAL FIELD

This invention relates to high pressure seals, and more particularly, to high pressure fluid seals for pumps having reciprocating plungers.

BACKGROUND OF THE INVENTION

In high pressure fluid pumps having reciprocating plungers, it is necessary to provide a seal around the plunger to prevent the leakage of high pressure fluid. In such pumps, the seal must be able to operate in a high pressure environment, withstanding pressures in excess of 10,000 psi, and even up to and beyond 50,000–70,000 psi.

Currently available seal designs for use in such an environment include an extrusion resistant seal supported by a back-up ring, the back-up ring and seal being held by a seal carrier. However, the tolerances for clearance between the plunger and back-up ring are very difficult to achieve and maintain. Very typically, therefore, the plunger and back-up ring come into contact, generating frictional heating, which in turn causes the seal to fail.

Accordingly, there is a need in the art for an improved high pressure fluid seal assembly, and in particular, a seal assembly that is simple to manufacture accurately, and that will increase the life of the seal. The present invention fulfills these needs, and provides further related advantages.

SUMMARY OF THE INVENTION

Briefly, the present invention provides an improved high pressure fluid seal assembly for use in a high pressure pump having a reciprocating plunger. In a preferred embodiment, the seal assembly includes a seal carrier having a bore through which the reciprocating plunger passes. The seal carrier has a first annular groove that is concentric with the bore and that carries an annular seal, an end region of the seal being supported by the seal carrier. The seal carrier has an integral annular guidance bearing that is positioned in a second annular groove of the seal carrier, the second annular groove and guidance bearing contained therein being concentric with the bore and being axially spaced from the first annular groove and seal. The bore through the seal carrier is therefore defined by an internal circumference of the guidance bearing, an internal circumference of the seal, and an inner region of the seal carrier positioned between the seal and the guidance bearing. An inner diameter of the guidance bearing is smaller than the inner diameter of the bore of the seal carrier in the region between the seal and the guidance bearing, thereby preventing the plunger from contacting the seal carrier. In this manner, the seal is supported by the seal carrier, and the seal carrier is separated from the plunger by the guidance bearing, thereby reducing frictional heating and extending the life of the seal. Also, the materials for the guidance bearing and plunger are selected to minimize the friction between the two elements.

The guidance bearing is positioned in the seal carrier, and the bore is then machined in the seal carrier and in the guidance bearing in the same setup, thereby improving the concentricity and alignment of the guidance bearing and portion of the seal carrier that supports the annular seal.

BRIEF DESCRIPTION THE DRAWINGS

DETAILED DESCRIPTION OF THE INVENTION

Figure 1:
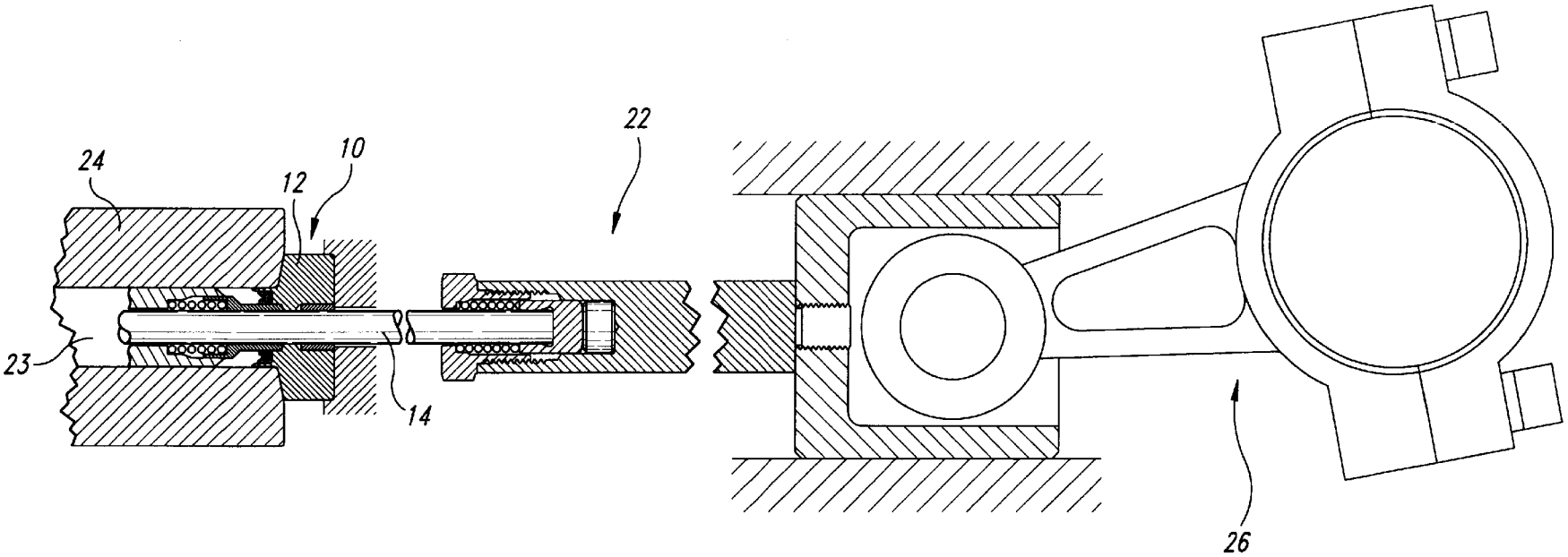
FIG. 1 is a cross-sectional plan view of a pump assembly incorporating a seal assembly provided in accordance with a preferred embodiment of the present invention.

An improved high pressure fluid seal assembly 10 is provided in accordance with a preferred embodiment of the present invention, as illustrated in FIG. 1. The seal assembly 10 is for use in a high pressure pump assembly 22 having a reciprocating plunger 14 coupled to a drive mechanism 26. The plunger 14 reciprocates in a high pressure cylinder 24, the seal assembly 10 preventing the leakage of high pressure fluid from a high pressure region 23 within the high pressure cylinder 24.

Figure 2:
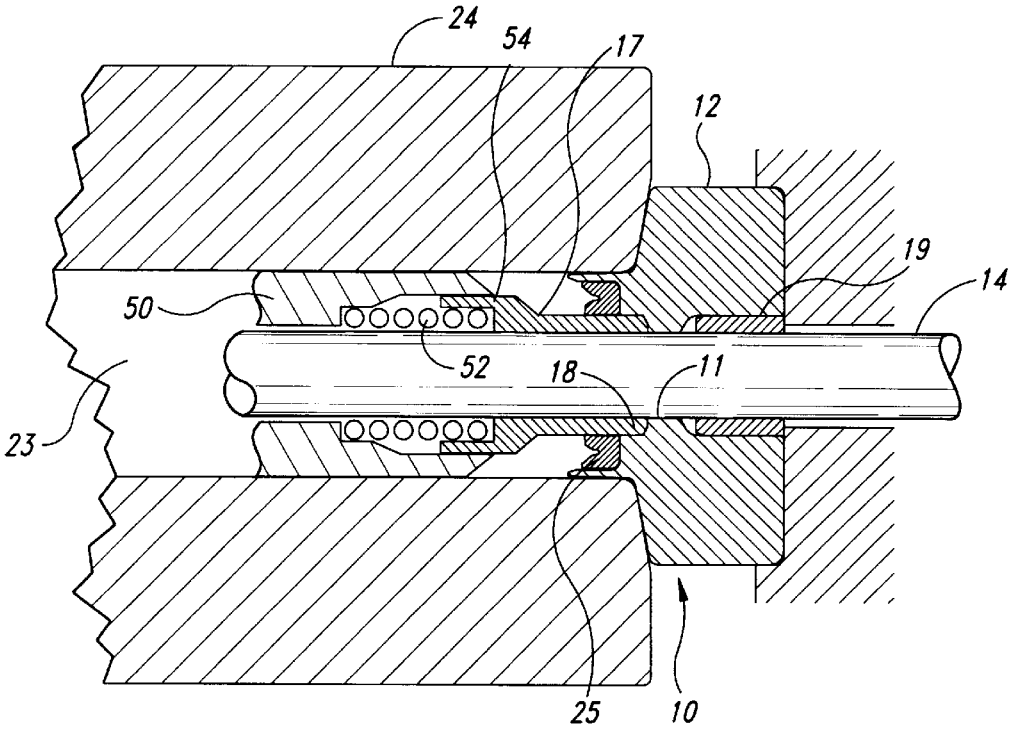
FIG. 2 is an enlarged cross-sectional plan view of the seal assembly illustrated in FIG. 1.
Figure 3:
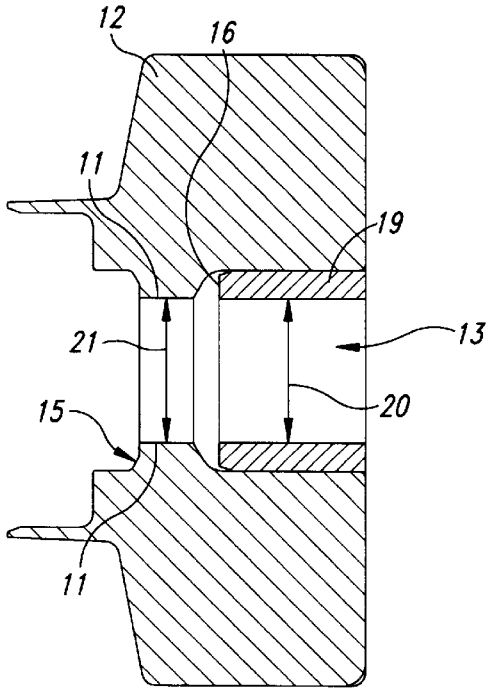
FIG. 3 is a cross-sectional plan view of an element of the seal assembly illustrated in FIGS. 1 and 2.

More particularly, as illustrated in FIGS. 2 and 3, the seal assembly 10 includes a seal carrier 12 having a bore 13 through which the reciprocating plunger 14 passes. The seal carrier 12 has a first annular groove 15 in which an annular seal 17 is positioned. An annular elastomeric seal 25 is provided around the outer circumference of annular seal 17, to energize the annular seal 17 during the start of a pressure stroke. A bushing 50 positioned within the high pressure region 23 houses a spring 52 which engages the annular seal 17 and urges it toward the first annular groove 15 to substantially prevent the annular seal from moving out of the first annular groove. The annular seal 17 has a flange portion 54 which engages the spring 52 and substantially prevents the spring from moving laterally into contact with the plunger 14. The seal carrier 12 also has an integral, annular guidance bearing 19, which is positioned in a second annular groove 16 within the bore 13. As seen in FIG. 3, the second annular groove 16 and guidance bearing 19 positioned therein are axially spaced from the first annular groove 15 and annular seal 17 contained therein.

The inner diameter 20 of the guidance bearing 19 is smaller than the inner diameter 21 of the seal carrier bore 13 in a region 11 between the seal 17 and guidance bearing 19. For example, in a preferred embodiment, the inner diameter 20 is 0.0005–0.0015 inch smaller than the inner diameter 21. In this manner, the end region 18 of annular seal 17 is supported by region 11 of the seal carrier 12; however, region 11 of seal carrier 12 is not in contact with the plunger 14, given the configuration of the guidance bearing 19.

A seal assembly provided in accordance with a preferred embodiment of the present invention therefore supports a seal directly by the seal carrier, eliminating the need for a back-up ring. The integral guidance bearing prevents the plunger from contacting the seal carrier, thereby reducing the frictional heating in the vicinity of the seal, which in turn extends the life of the seal. To further increase the longevity of the assembly, the materials for the components are selected to minimize the friction between the plunger and the guidance bearing and between the plunger and the seal. In a preferred embodiment, the plunger 14 is made of partially stabilized zirconia ceramic, the guidance bearing 19 is made of a resin impregnated graphite, and the seal 17 is made of an ultra-high molecular weight polyethylene. However, it should be noted that a variety of materials may be used, and the selection of the materials for the components are interdependent.

To further increase the reliability of the seal, the seal assembly is preferably manufactured by pressing the guidance bearing 19 into the seal carrier 12, and machining the bore through the guidance bearing and through region 11 of the seal carrier in the same machining setup. As discussed above, the inner diameter of the bore in region 11 is machined slightly larger than the inner diameter 20 of the bore through the guidance bearing. However, by machining both areas in the same setup, the concentricity of the elements is improved, as compared to prior art systems wherein elements of a seal assembly are machined independently and then assembled.

An improved high pressure fluid seal assembly has been shown and described. From the foregoing, it will be appreciated that, although specific embodiments of the invention have been described herein for purposes of illustration, various modifications may be made without deviating from the spirit of the invention Thus, the present invention is not limited to the embodiments described herein, but rather as defined by the claims which follow.

We claim:

1. A high pressure fluid seal assembly comprising:

a seal carrier having a bore through which a reciprocating plunger may pass, and having a first annular groove concentric with the bore and a second annular groove that is concentric with the bore and that is axially spaced from the first annular groove;

an annular seal positioned in the first annular groove and facing the plunger, an end region of the seal being supported by the seal carrier; and an annular guidance bearing positioned in the second annular groove to contact the plunger, an inner diameter of the annular guidance bearing being from about 0.0005 to about 0.0015 inch smaller than an inner diameter of the bore of the seal carrier in a region between the first annular groove and the second annular groove.

2. The assembly of claim 1 wherein the end region of the seal is a first end region and the seal has a second end region opposite the first end region, the second end region having a flange extending away therefrom concentric with the plunger when the plunger passes through the bore of the seal carrier, the flange being configured to engage an outer surface of a coil spring biased against the seal to resist motion of the spring toward the plunger.

3. The assembly of claim 1 wherein the end region of the seal is a first end region, the seal having a second end region opposite the first end region, the second end region having a flange extending away therefrom concentric with the plunger when the plunger passes through the bore of the seal carrier, the assembly further comprising:

a bushing proximate the second end region of the seal; and a spring positioned between the bushing and the second end region of the seal to bias the seal toward the seal, the flange of the seal engaging an outer surface of the spring to resist motion of the spring toward the plunger.

4. The assembly of claim 3 wherein the spring is a coil spring comprising a coiled filament and the flange engages an outer surface of the filament.

5. A high pressure fluid seal carrier comprising:

a body having a bore through which a reciprocating plunger may pass, and having an annular groove concentric with the bore adapted to receive an annular seal, the seal carrier being provided with an annular guidance bearing that is concentric with the bore to contact the plunger and is axially spaced from the annular groove, the inner circumference of the annular guidance bearing forming a portion of the bore through which the reciprocating plunger may pass, an inner diameter of the annular guidance bearing being from about 0.0005 to about 0.0015 inch smaller than an inner diameter of the bore of the seal carrier in the region between the annular groove and the annular guidance bearing.

6. A high pressure pump assembly comprising:

a plunger coupled to a drive mechanism, the plunger reciprocating in a high pressure chamber formed in a high pressure cylinder, and a seal assembly provided adjacent to the high pressure chamber to substantially prevent the leakage of high pressure fluid from the high pressure chamber, the seal assembly having a bore through which the reciprocating plunger passes, and having a first annular groove concentric with the bore and a second annular groove that is axially spaced from the first annular groove and that is concentric with the bore, an annular seal being positioned in the first annular groove, an end region of the seal being supported by the seal carrier, and an annular guidance bearing positioned in the second annular groove to contact the plunger, an inner diameter of the annular guidance bearing being from about 0.0005 to about 0.0015 inch smaller than an inner diameter of the bore of the seal carrier in the region between the first annular groove and the second annular groove, such that the plunger is in contact with the guidance bearing, but is not in contact with the seal carrier.

7. The assembly according to claim 6, further comprising an elastomeric seal positioned around an outer circumference of the annular seal to energize the annular seal during the start of a pressure stroke.

8. The assembly according to claim 6 wherein the materials of the annular guidance bearing, the plunger and the seal are selected to ensure that a low coefficient of friction exists between the plunger and the seal and between the plunger and the guidance bearing.

9. The apparatus according to claim 8 wherein the plunger is made of partially stabilized zirconia ceramic, the guidance bearing is made of resin impregnated graphite, and the seal is made of an ultra-high molecular weight polyethylene.

10. A high pressure fluid seal, comprising a seal body having a bore through which a reciprocating plunger may pass, the seal body further having a first end configured to be received by a seal carrier and support the seal relative to the plunger, and a second end opposite the first end, the second end having an annular flange projecting outwardly therefrom concentric with the bore, the flange being configured to engage a coil spring and restrict motion of the coil spring toward the plunger when the plunger passes through the bore.

* * * * *

UNITED STATES PATENT AND TRADEMARK OFFICE

CERTIFICATE OF CORRECTION

PATENT NO : 6,086,070
DATED : July 11, 2000
INVENTOR(S) : Olivier L. Tremoulet, Jr. et al.

It is certified that errors appear in the above-identified patent and that said Letters Patent are hereby corrected as shown below:

Section [75], Inventors, on the first page, should include --Katherine M. Madden, Kent, WA--.

Signed and Sealed this

First Day of May, 2001

*Attest:*

Nicholas P. Godici

NICHOLAS P. GODICI

*Attesting Officer*

*Acting Director of the United States Patent and Trademark Office*